US011445884B2

(12) United States Patent
Ross et al.

(10) Patent No.: US 11,445,884 B2
(45) Date of Patent: Sep. 20, 2022

(54) DISHWASHER APPLIANCE MAIN CONDUIT WITH PRESSURE RELIEF HOLE

(71) Applicant: Haier US Appliance Solutions, Inc., Wilmington, DE (US)

(72) Inventors: Christopher Brandon Ross, Louisville, KY (US); Matthew David Mersch, Louisville, KY (US); Adam Christopher Hofmann, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 17 days.

(21) Appl. No.: 17/106,773

(22) Filed: Nov. 30, 2020

(65) Prior Publication Data

US 2022/0167824 A1 Jun. 2, 2022

(51) Int. Cl.
*A47L 15/42* (2006.01)

(52) U.S. Cl.
CPC ..... *A47L 15/4221* (2013.01); *A47L 15/4225* (2013.01); *A47L 15/4278* (2013.01)

(58) Field of Classification Search
None
See application file for complete search history.

(56) References Cited

U.S. PATENT DOCUMENTS

| | | | |
|---|---|---|---|
| 7,594,513 | B2 | 9/2009 | VanderRoest et al. |
| 7,947,132 | B2 | 5/2011 | Vanderroest et al. |
| 7,963,292 | B2 | 6/2011 | Kennichi et al. |
| 9,295,368 | B2 | 3/2016 | Feddema |
| 9,474,434 | B2 | 10/2016 | Carlson et al. |
| 9,795,273 | B2 | 10/2017 | Pyo |
| 9,867,519 | B2 | 1/2018 | Kim et al. |
| 2019/0343366 | A1 | 11/2019 | Lee |

FOREIGN PATENT DOCUMENTS

| | | | |
|---|---|---|---|
| CN | 103330541 | A | 10/2013 |
| CN | 110840358 | A | 2/2020 |
| WO | WO2004/002286 | A2 | 1/2004 |

*Primary Examiner* — Levon J Shahinian
(74) *Attorney, Agent, or Firm* — Dority & Manning, P.A.

(57) ABSTRACT

A dishwasher appliance includes a tub that defines a wash chamber for receipt of articles for washing. The dishwasher appliance also includes a lower spray assembly located in the wash chamber and configured to direct a spray of fluid into the wash chamber. The dishwasher appliance further includes an upper spray assembly located in the wash chamber above the lower spray assembly along the vertical direction. The upper spray assembly is configured to direct a spray of fluid into the wash chamber. A sump is positioned at a bottom of the wash chamber for receiving fluid from the wash chamber. The dishwasher appliance further includes a pump in fluid communication with the sump. The pump is configured to draw fluid from the sump. A main conduit extends between the pump and the upper spray assembly. The main conduit includes an upper end and a hole defined in the upper end.

18 Claims, 4 Drawing Sheets

DISHWASHER APPLIANCE MAIN CONDUIT WITH PRESSURE RELIEF HOLE

FIELD

The present subject matter relates generally to dishwasher appliances, and in particular to fluid circulation systems for dishwasher appliances.

BACKGROUND

Dishwasher appliances generally include a tub that defines a wash compartment. Rack assemblies can be mounted within the wash chamber of the tub for receipt of articles for washing. Spray assemblies within the wash chamber can apply or direct wash fluid towards articles disposed within the rack assemblies in order to clean such articles. Multiple spray assemblies can be provided including, e.g., a lower spray arm assembly mounted to the tub at a bottom of the wash chamber, a mid-level spray arm assembly mounted to one of the rack assemblies, and/or an upper spray assembly mounted to the tub at a top of the wash chamber.

Dishwasher appliances further typically include a fluid circulation system which is in fluid communication with the spray assemblies for circulating fluid to the spray assemblies. Such fluid circulation systems typically include at least one pump for circulating fluid through the multiple spray assemblies. The number of spray assemblies in a dishwasher appliance may vary from one unit to another, e.g., some dishwasher appliances include only a two-tiered spray system, whereas other dishwasher appliances include three levels of spray assemblies and/or specialized spray assemblies such as utensil jets or bottle sprayers. Additionally, some dishwasher appliances include a device, such as a diverter, to control the flow of fluid received from the pump, such as by selectively directing the flow of fluid to one or more spray assemblies, including less than all of the spray assemblies in some cycles or operations while directing the flow of fluid to a greater number, up to and including all, of the spray assemblies in other cycles or operations.

Thus, the number of spray assemblies that receive the flow of fluid from the pump can vary from one unit to another, and even from one operation to another within the same unit. This may result in difficulties across the different units or operations, such as not enough pressure when a greater number of spray assemblies are in use or too much pressure when a lesser number of spray assemblies are in use. For example, not enough pressure can cause the spray arms to spin too slowly, such that they might stall out and not provide enough water coverage. As another example, too much pressure can cause the spray arms to spin too fast, which may lead to the water jet issuing from the spray assembly or assemblies breaking apart due to the increase in centrifugal force, which negatively impacts the wash performance.

Accordingly, a dishwashing appliance having features to equalize the pressure supplied in various units would be useful. More particularly, a fluid circulation system for a dishwasher appliance having a two-tiered spray system with pressure-reducing features that permits usage of a common pump and other circulation system components, e.g., spray arms, with a three-tiered spray system would be desired.

BRIEF DESCRIPTION

Aspects and advantages of the technology will be set forth in part in the following description, or may be apparent from the description, or may be learned through practice of the technology.

In an exemplary embodiment, a dishwasher appliance is provided. The dishwasher appliance defines a vertical direction, a lateral direction, and a transverse direction that are mutually perpendicular. The dishwasher appliance includes a tub that defines a wash chamber for receipt of articles for washing. The dishwasher appliance also includes a lower spray assembly located in the wash chamber and configured to direct a spray of fluid into the wash chamber. The dishwasher appliance further includes an upper spray assembly located in the wash chamber above the lower spray assembly along the vertical direction. The upper spray assembly is configured to direct a spray of fluid into the wash chamber. A sump is positioned at a bottom of the wash chamber for receiving fluid from the wash chamber. The dishwasher appliance further includes a pump in fluid communication with the sump. The pump is configured to draw fluid from the sump. A main conduit extends between the pump and the upper spray assembly. The upper spray assembly is fluidly coupled to an outlet of the main conduit. The main conduit includes an upper end and a hole defined in the upper end downstream of the outlet of the main conduit.

In another exemplary embodiment, a dishwasher appliance is provided. The dishwasher appliance includes a tub that defines a wash chamber for receipt of articles for washing. The dishwasher appliance also includes a lower spray assembly located in the wash chamber and configured to direct a spray of fluid into the wash chamber. The dishwasher appliance further includes an upper spray assembly located in the wash chamber above the lower spray assembly along the vertical direction. The upper spray assembly is configured to direct a spray of fluid into the wash chamber. A sump is positioned at a bottom of the wash chamber for receiving fluid from the wash chamber. The dishwasher appliance further includes a pump in fluid communication with the sump. The pump is configured to draw fluid from the sump. A main conduit extends between the pump and the upper spray assembly. The main conduit includes an upper end and a hole defined in the upper end.

These and other features, aspects and advantages of the present technology will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present technology, including the best mode thereof, directed to one of ordinary skill in the art, is set forth in the specification, which makes reference to the appended figures.

DETAILED DESCRIPTION

Figure 1:
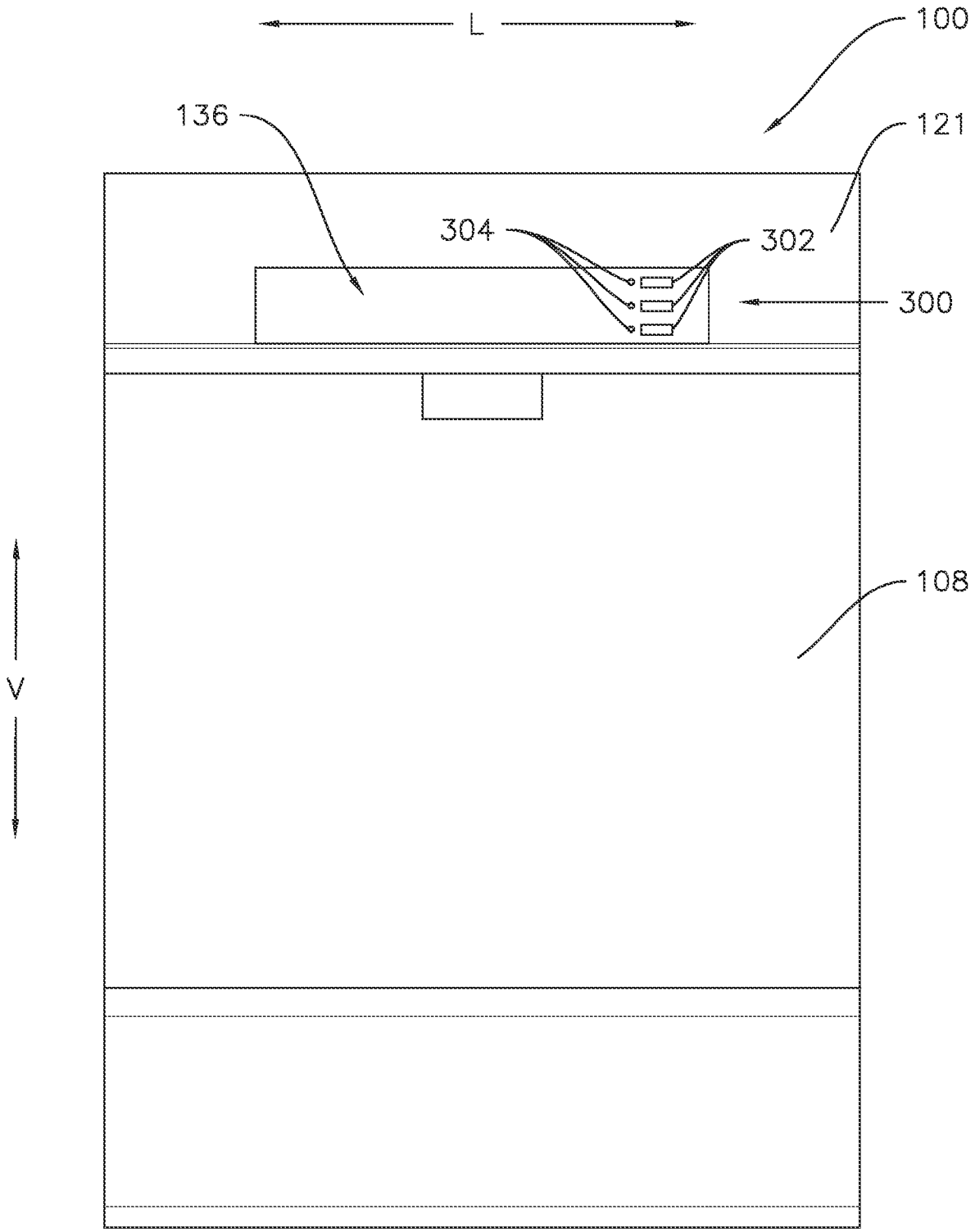
FIG. 1 provides a front view of an example dishwashing appliance as may incorporate a control console in accordance with at least one embodiment of the present subject matter.

Reference now will be made in detail to embodiments of the technology, one or more examples of which are illustrated in the drawings. Each example is provided by way of explanation of the technology, not limitation of the technology. In fact, it will be apparent to those skilled in the art that various modifications and variations can be made in the present disclosure without departing from the scope or spirit of the invention. For instance, features illustrated or described as part of one embodiment can be used with another embodiment to yield a still further embodiment. Thus, it is intended that the present technology covers such modifications and variations as come within the scope of the appended claims and their equivalents.

As used herein, the terms "first," "second," and "third" may be used interchangeably to distinguish one component from another and are not intended to signify location or importance of the individual components. As used herein, terms of approximation such as "generally," "about," or "approximately" include values within ten percent greater or less than the stated value. When used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

Figure 2:
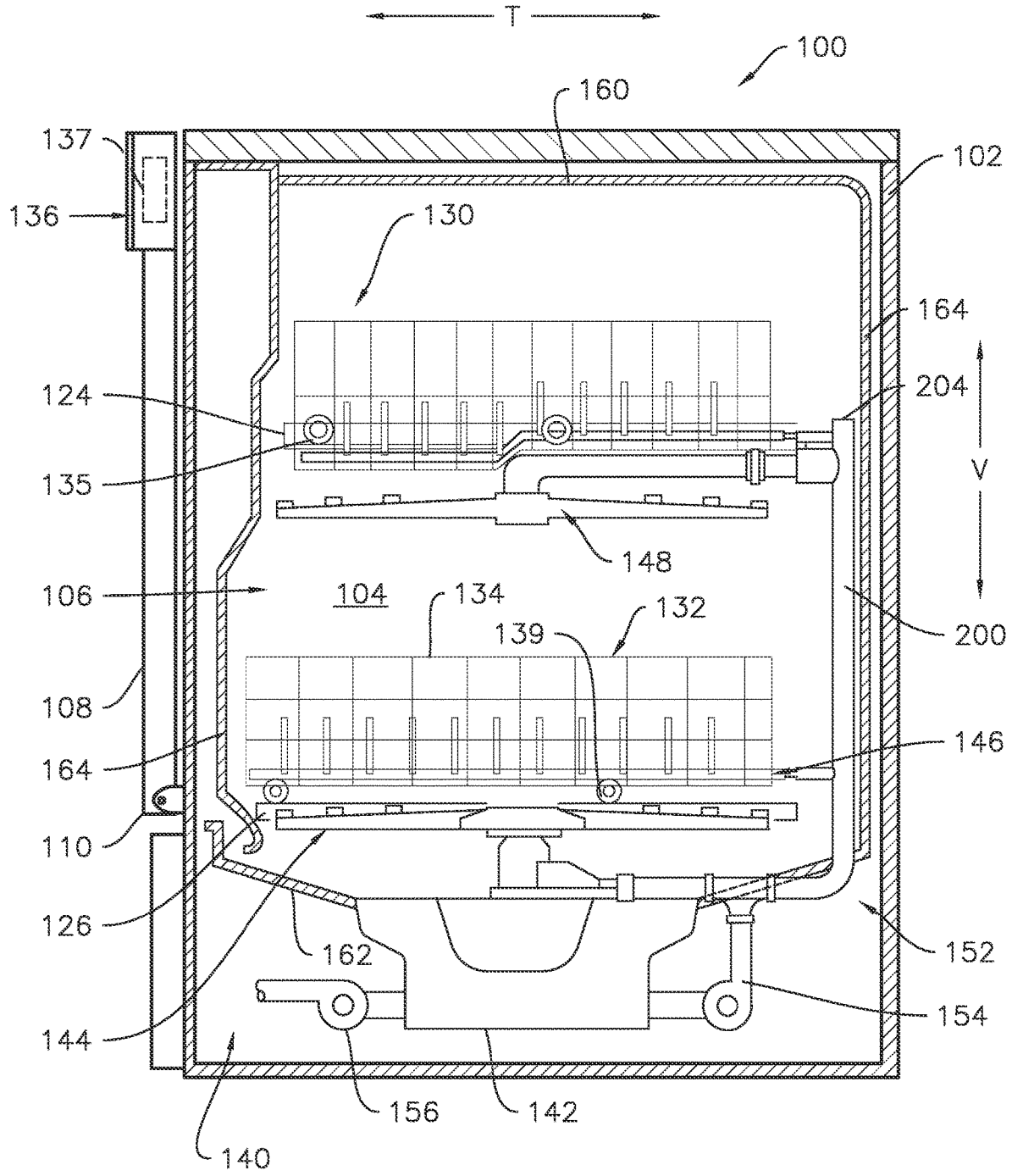
FIG. 2 provides a cross-sectional side view of the dishwashing appliance shown in FIG. 1, particularly illustrating various internal components of the dishwashing appliance.

Referring now to the drawings, FIGS. 1 and 2 illustrate one embodiment of a domestic dishwashing appliance 100 that may incorporate a fluid circulation system, including a main conduit thereof, in accordance with aspects of the present disclosure. As shown in FIGS. 1 and 2, the dishwashing appliance 100 may include a cabinet 102 having a tub 104 therein defining a wash chamber 106. The tub 104 may generally include a front opening (not shown) and a door 108 hinged at its bottom 110 for movement between a normally closed vertical position (shown in FIGS. 1 and 2), wherein the wash chamber 106 is sealed shut for washing operation, and a horizontal open position (not shown) for loading and unloading of articles from the dishwashing appliance 100.

As is understood, the tub 104 may generally have a rectangular cross-section defined by various wall panels or walls. For example, as shown in FIG. 2, the tub 104 may include a top wall 160 and a bottom wall 162 spaced apart from one another along a vertical direction V of the dishwashing appliance 100. Additionally, the tub 104 may include a plurality of sidewalls 164 (e.g., four sidewalls) extending between the top and bottom walls 160, 162. It should be appreciated that the tub 104 may generally be formed from any suitable material. However, in several embodiments, the tub 104 may be formed from a ferritic material, such as stainless steel, or a polymeric material.

As particularly shown in FIG. 2, upper and lower guide rails 124, 126 may be mounted on opposing side walls 164 of the tub 104 and may be configured to accommodate roller-equipped rack assemblies 130 and 132. Each of the rack assemblies 130, 132 may be fabricated into lattice structures including a plurality of elongated members 134 (for clarity of illustration, not all elongated members making up assemblies 130 and 132 are shown in FIG. 2). Additionally, each rack 130, 132 may be adapted for movement along a transverse direction T between an extended loading position (not shown) in which the rack is substantially positioned outside the wash chamber 106, and a retracted position (shown in FIGS. 1 and 2) in which the rack is located inside the wash chamber 106. This may be facilitated by rollers 135 and 139, for example, mounted onto racks 130 and 132, respectively. As is generally understood, a silverware basket (not shown) may be removably attached to rack assembly 132 for placement of silverware, utensils, and the like, that are otherwise too small to be accommodated by the racks 130, 132. As may be seen collectively in FIGS. 1 and 2, the dishwashing appliance 100 may define the vertical direction V, the transverse direction T, and a lateral direction L. The vertical direction V, lateral direction L, and transverse direction T are mutually perpendicular and form an orthogonal direction system.

Additionally, the dishwashing appliance 100 may also include a lower spray-arm assembly 144 that is configured to be rotatably mounted within a lower region 146 of the wash chamber 106 directly above the bottom wall 162 of the tub 104 so as to rotate in relatively close proximity to the rack assembly 132. As shown in FIG. 2, an upper spray-arm assembly 148 may be located in an upper region of the wash chamber 106, such as by being located in close proximity to the upper rack 130. Also as illustrated in FIG. 2, the fluid circulation system 152 is a two level or two-tiered system, e.g., spray arm assemblies are provided at only two levels within the wash chamber 106, such that the lower spray assembly 144 and the upper spray assembly 148 are the only spray assemblies in the dishwasher appliance 100.

As is generally understood, the lower and upper spray-arm assemblies 144 and 148 may generally form part of a fluid circulation system 152 for circulating fluid (e.g., water and dishwashing fluid which may also include water, detergent, and/or other additives, and may be referred to as wash liquor) within the tub 104. As shown in FIG. 2, the fluid circulation system 152 may also include a recirculation pump 154 located in a machinery compartment 140 below the bottom wall 162 of the tub 104, as is generally recognized in the art, and one or more fluid conduits for circulating the fluid delivered from the pump 154 to and/or throughout the wash chamber 106. For example, the one or more fluid conduits may include a main conduit 200 which extends between the pump 154 and the upper spray assembly 148, as will be described in more detail below. The tub 104 may include a sump 142 positioned at a bottom of the wash chamber 106 for receiving fluid from the wash chamber 106. The recirculation pump 154 receives fluid from sump 142 to provide a flow to fluid circulation system 152, which may include a switching valve or diverter (not shown) to select flow to one or more of the lower and upper spray-arm assemblies 144, 148.

Moreover, each spray-arm assembly 144, 148 may include an arrangement of discharge ports or orifices for directing washing liquid onto dishes or other articles located in rack assemblies 130 and 132, which may provide a rotational force by virtue of washing fluid flowing through the discharge ports. The resultant rotation of the lower spray-arm assembly 144 provides coverage of dishes and other dishwasher contents with a washing spray.

A drain pump 156 may also be provided in the machinery compartment 140 and in fluid communication with the sump 142. The drain pump 156 may be in fluid communication with an external drain (not shown) to discharge fluid, e.g., used wash liquid, from the sump 142.

The dishwashing appliance 100 may be further equipped with a controller 137 configured to regulate operation of the dishwasher 100. The controller 137 may generally include one or more memory devices and one or more microprocessors, such as one or more general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwashing appliance 100. In the illustrated embodiment, the controller 137 is located within a control panel area 121 of the door 108. In such an embodiment, input/output ("I/O") signals may be routed between the control system and various operational components of the dishwashing appliance 100 along wiring harnesses that may be routed through the bottom of the door 108. Typically, the controller 137 is in operative communication with a user interface panel/control console cover 136 through which a user may select various operational features and modes and monitor progress of the dishwasher 100. The console cover 136 may be a part of a control console 300, e.g., the console cover 136 may be a front panel of the control console 300. In one embodiment, the console cover 136 and/or control console 300 may represent a general purpose I/O ("GPIO") device or functional block. Additionally, the control console 300 may include input components, such as one or more of a variety of electrical, mechanical or electro-mechanical input devices including rotary dials, push buttons, touch pads, and touch screens. The console cover 136 may also include a display component, such as a digital or analog display device designed to provide operational feedback to a user. For example, the console cover 136 may include input components such as buttons 302, examples of which are illustrated in FIG. 1 and the display component may include a plurality of indicators 304, with each indicator 304 corresponding to a respective one of the buttons 302. The buttons 302 may be mechanical push buttons, capacitive touch sensors, or any other suitable type of button, including combinations of different types of buttons. As is generally understood, the control console 300 may be in communication with the controller 137 via one or more signal lines or shared communication busses. It should be noted that controllers 137 as disclosed herein are capable of and may be operable to perform any methods and associated method steps as disclosed herein. A variety of text, digits, and/or symbols may be printed on console cover 136 to indicate, e.g., which features or options of the appliance 100 are associated with each button 302.

It should be appreciated that the present subject matter is not limited to any particular style, model, or configuration of dishwashing appliance. The exemplary embodiment depicted in FIGS. 1 and 2 is simply provided for illustrative purposes only. For example, different locations may be provided for the console cover 136, different configurations may be provided for the racks 130, 132, and other differences may be applied as well.

Figure 3:
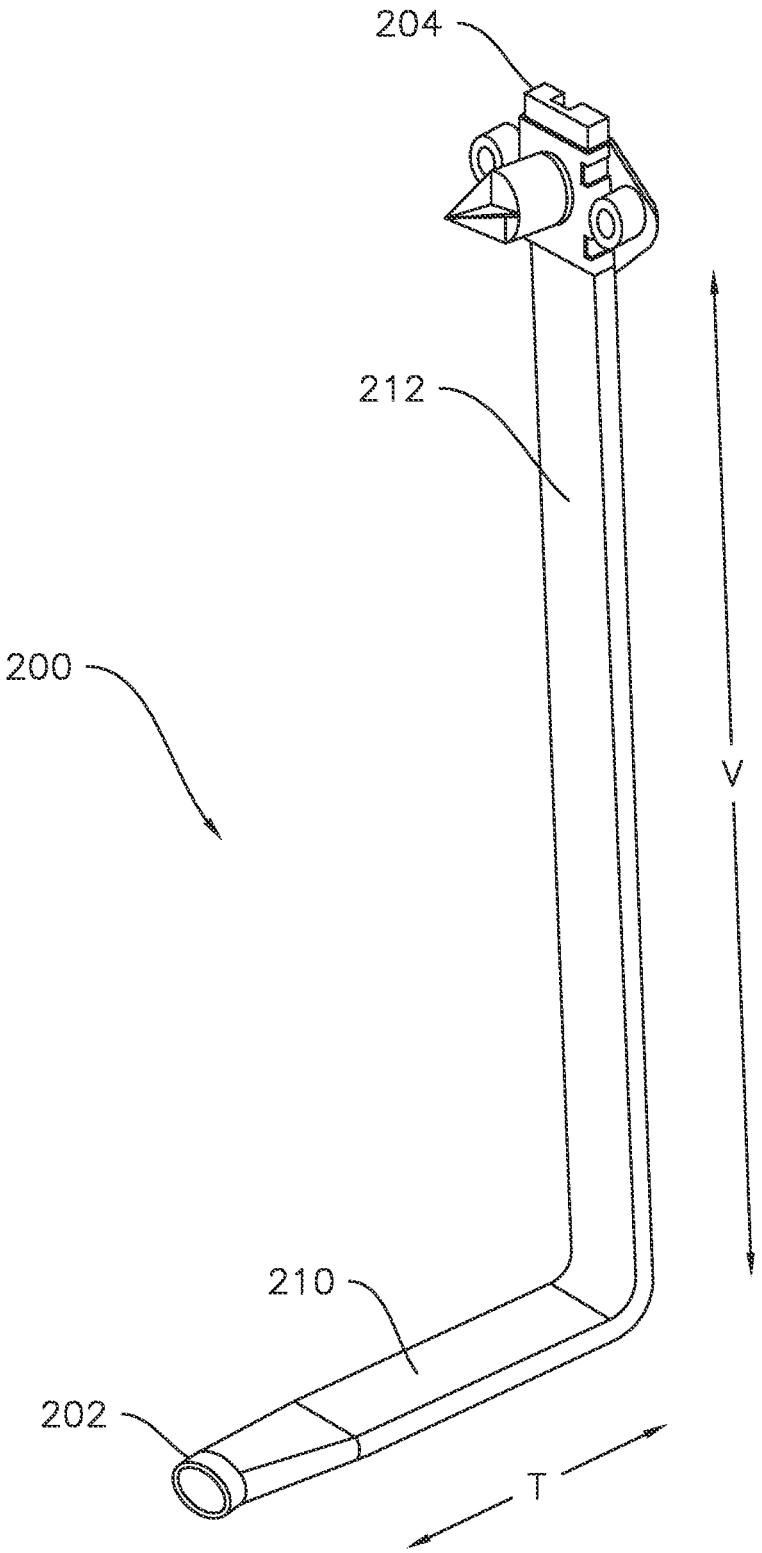
FIG. 3 provides a perspective view of a main conduit as may be incorporated into a fluid circulation system of a dishwasher appliance according to at least one exemplary embodiment of the present subject matter.
Figure 4:
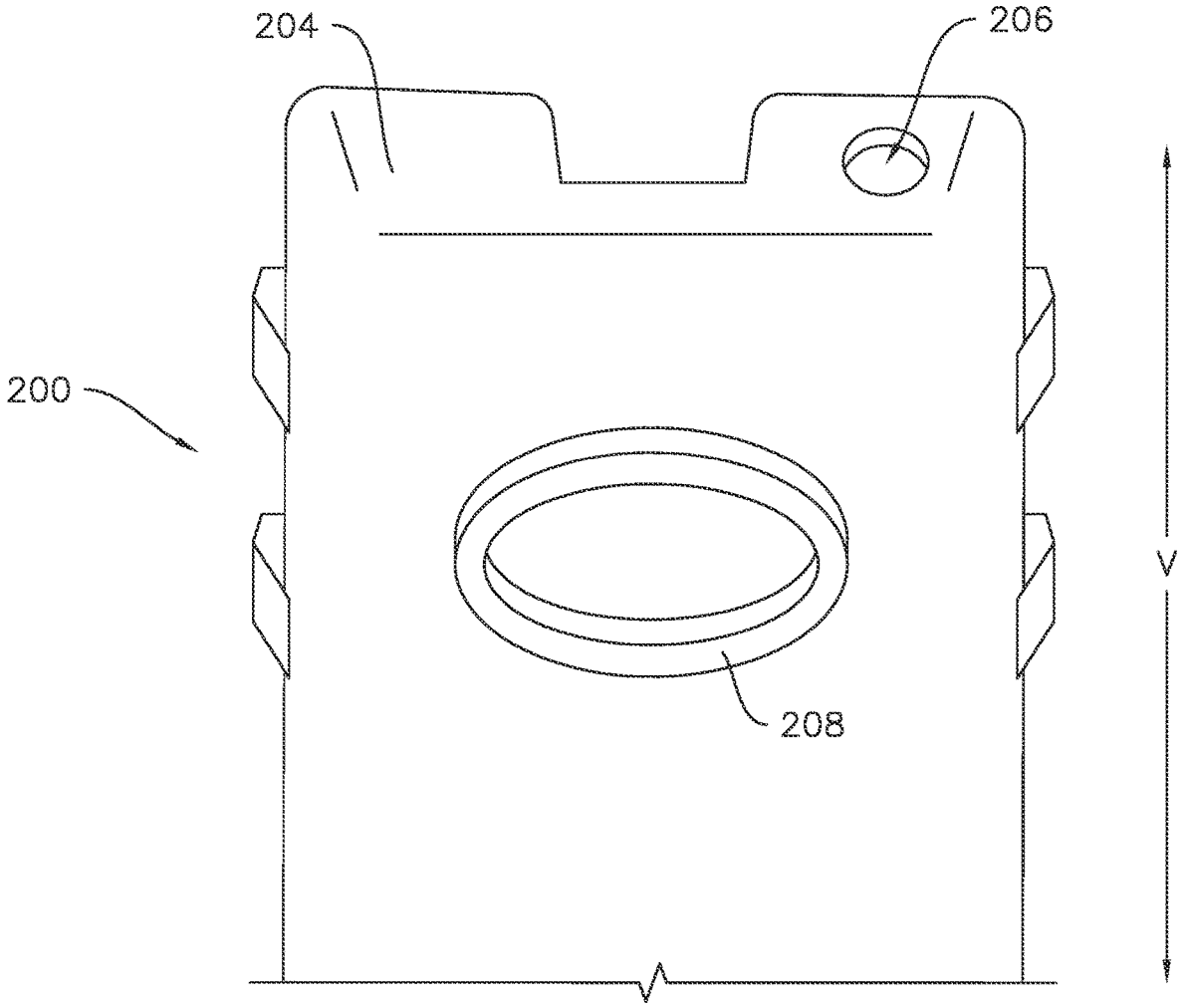
FIG. 4 provides a perspective view of a portion of the main conduit of FIG. 3.

FIGS. 3 and 4 depict an exemplary main conduit 200 in isolation from other components of the fluid circulation system 152 in order to more clearly illustrate features of the main conduit 200. As illustrated in FIG. 3, the main conduit may extend from, e.g., begin at, an inlet end 202. The inlet end 202 may be coupled to the recirculation pump 154 (FIG. 2). For example, in some embodiments, the inlet end 202 may be coupled directly to the recirculation pump 152. In other embodiments, the inlet end 202 may be coupled to the recirculation pump 152 via a fitting, such as a tee fitting. The main conduit 200 may extend to, e.g., end at, an upper end 204. For example, the upper end 204 of the main conduit 200 may define a vertically uppermost terminus of the main conduit 200.

The main conduit 200 may include a vertical leg 212 extending generally along the vertical direction and generally parallel to a sidewall 164 (FIG. 2) of the tub 104. The main conduit 200 may also include a horizontal leg 210 which extends along a direction generally parallel to the vertical direction V, such as generally along the transverse direction T as illustrated in FIGS. 2 and 3. As may be seen in FIGS. 2 and 3, the sidewall 164 of the tub 104 defines a first height along the vertical direction V the vertical leg 212 of the main conduit 200 defines a second height along the vertical direction V, and the second height is less than the first height. In various embodiments, the second height may be about ninety percent or less of the first height, such as about seventy-five percent of the first height or less, such as about sixty percent of the first height or less, such as about two-thirds or about sixty-seven percent of the first height.

As illustrated in FIG. 4, the main conduit 200 may include an outlet 208 proximate, e.g., below, the top end 204 of the main conduit 200. For example, the outlet 208 may be positioned on the vertical leg 212 of the main conduit 200 and closer to the top end 204 than to the horizontal leg 210 or closer to the top end 204 than to a bend defined at an intersection of the vertical leg 212 and the horizontal leg 210. The upper spray assembly 148 may be fluidly coupled to the outlet 208 of the main conduit 200, such as detachably or removably fluidly coupled to the outlet 208, e.g., as illustrated in FIG. 2, where the conduit of the upper spray assembly 148 is mounted to the upper rack 130, such that the conduit of the upper spray assembly 148 is connected to the outlet 208 when the upper rack 130 is in the retracted position as shown in FIG. 2, whereas the conduit of the upper spray assembly 148 may detach from the outlet 208 when the upper rack 130 is extended.

As best seen in FIG. 4, the main conduit 200 may further include one or more holes 206 in the upper end 204 of the main conduit 200. As illustrated in FIG. 4, the hole 206 is downstream of the outlet 208. For example, where wash liquid flows into the main conduit 200 from the recirculation pump 154 at the inlet 202 of the main conduit and flows through the main conduit 200 from the inlet 202 to the upper end 204, the hole 206 is downstream of the outlet 208 with respect to the flow of wash liquid through the fluid circulation system 152. Although only a single hole 206 is illustrated in FIG. 4, those of ordinary skill in the art will recognize that additional holes, e.g., a second hole 206, may be provided which are substantially similar to the illustrated hole 206. For example, the second hole 206 may be the same size and shape as the illustrated hole 206 and may be positioned opposite the illustrated hole 206 along the lateral direction L, e.g., the second hole 206 may be a mirror of the illustrated hole 206 such that the upper end 204 of the main conduit 200 is symmetrical about the vertical direction V.

Additionally, as may be seen throughout FIGS. 2 through 4, the hole 206 is not attached to anything, e.g., the hole 206 is not directly connected to any spray assembly, nozzle, etc. Thus, wash liquid may exit the main conduit 200 at the hole 206. With the main conduit 200 positioned within the tub 104 as illustrated in FIG. 2, such wash liquid issuing from the hole 206 may form an additional, e.g., third, spray of wash liquid into the wash chamber 106. For example, the hole 206 may be oriented upward along the vertical direction V and/or towards the top wall 160 of the tub 104. For example, the hole 206 may be oriented generally perpendicular to the top wall 160 of the tub 104, e.g., the hole 206 may define a longitudinal axis and the longitudinal axis of the hole 206 may be generally perpendicular to the top wall 160 of the tub 104. Thus, wash liquid that sprays out of the hole 206 may fall back down onto articles in the upper rack 130, e.g., after deflecting off of the top wall 160 and/or a rear wall of the plurality of sidewalls 164, or after travelling upwards through the air within the wash chamber 106 without reaching the wall(s).

The hole 206 generally defines an open area, e.g., the cross-sectional area of the hole 206 in a plane generally perpendicular to the vertical direction V is an open area, void, or aperture in the upper end 204 of the main conduit 200. In some embodiments, the open area defined by the hole 206 may be about one-tenth of a square inch (0.10 $in^2$) or less, such as about seven hundredths of a square inch (0.07 $in^2$) or less, such as about five hundredths of a square inch (0.05 $in^2$) or less, such as about three hundredths of a square inch (0.03 $in^2$) or less, such as about twenty-two thousandths of a square inch (0.022 $in^2$).

This written description uses examples to disclose the technology, including the best mode, and also to enable any person skilled in the art to practice the technology, including making and using any devices or systems and performing any incorporated methods. The patentable scope of the technology is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance defining a vertical direction, a lateral direction, and a transverse direction that are mutually perpendicular, the dishwasher appliance comprising:

a tub defining a wash chamber for receipt of articles for washing;

a lower spray assembly located in the wash chamber and configured to direct a spray of fluid into the wash chamber;

an upper spray assembly located in the wash chamber above the lower spray assembly along the vertical direction, the upper spray assembly configured to direct a spray of fluid into the wash chamber;

a sump positioned at a bottom of the wash chamber for receiving fluid from the wash chamber;

a pump in fluid communication with the sump, the pump configured to draw fluid from the sump; and a main conduit extending between the pump and the upper spray assembly, the upper spray assembly fluidly coupled to an outlet of the main conduit, the main conduit comprising an upper end and a hole defined in the upper end downstream of the outlet of the main conduit, wherein the lower spray assembly and the upper spray assembly are the only spray assemblies in the dishwasher appliance.

2. The dishwasher appliance of claim 1, wherein the upper spray assembly is positioned below a rack of the dishwasher appliance along the vertical direction.

3. The dishwasher appliance of claim 1, wherein the upper end of the main conduit defines a vertically uppermost terminus of the main conduit.

4. The dishwasher appliance of claim 1, wherein the hole defined in the upper end is oriented upward along the vertical direction.

5. The dishwasher appliance of claim 1, further comprising a second hole defined in the upper end of the main conduit.

6. The dishwasher appliance of claim 1, wherein the tub comprises a top wall and the hole defined in the upper end is generally perpendicular to the top wall.

7. The dishwasher appliance of claim 1, wherein the main conduit comprises a vertical leg extending generally along the vertical direction and generally parallel to a sidewall of the tub, the sidewall of the tub defining a first height along the vertical direction, the vertical leg of the main conduit defining a second height along the vertical direction, and wherein the second height is less than the first height.

8. The dishwasher appliance of claim 7, wherein the second height is about ninety percent or less of the first height.

9. The dishwasher appliance of claim 1, wherein the hole defines an open area of about one-tenth of a square inch or less.

10. A dishwasher appliance, comprising:

a tub defining a wash chamber for receipt of articles for washing;

a lower spray assembly located in the wash chamber and configured to direct a spray of fluid into the wash chamber;

an upper spray assembly located in the wash chamber above the lower spray assembly, the upper spray assembly configured to direct a spray of fluid into the wash chamber;

a sump positioned at a bottom of the wash chamber for receiving fluid from the wash chamber;

a pump in fluid communication with the sump, the pump configured to draw fluid from the sump; and a main conduit extending between the pump and the upper spray assembly, the main conduit comprising an upper end and a hole defined in the upper end, wherein the lower spray assembly and the upper spray assembly are the only spray assemblies in the dishwasher appliance.

11. The dishwasher appliance of claim 10, wherein the upper spray assembly is positioned below a rack of the dishwasher appliance.

12. The dishwasher appliance of claim 10, wherein the main conduit terminates at the upper end of the main conduit.

13. The dishwasher appliance of claim 10, wherein the hole defined in the upper end is oriented towards a top wall of the tub.

14. The dishwasher appliance of claim 10, further comprising a second hole defined in the upper end of the main conduit.

15. The dishwasher appliance of claim 10, wherein the tub comprises a top wall and the hole defined in the upper end is generally perpendicular to the top wall.

16. The dishwasher appliance of claim 10, wherein the main conduit comprises a vertical leg extending generally parallel to a sidewall of the tub, the sidewall of the tub defining a first height, the vertical leg of the main conduit defining a second height, and wherein the second height is less than the first height.

17. The dishwasher appliance of claim 16, wherein the second height is about ninety percent or less of the first height.

18. The dishwasher appliance of claim 10, wherein the hole defines an open area of about one-tenth of a square inch or less.

* * * * *